US005179219A

United States Patent [19]

Priegnitz

[11] Patent Number: 5,179,219

[45] Date of Patent: Jan. 12, 1993

[54] PROCESS FOR SEPARATING FATTY ACIDS AND TRIGLYCERIDES

[75] Inventor: James W. Priegnitz, Elgin, Ill.

[73] Assignee: UOP, Des Plaines, Ill.

[21] Appl. No.: 615,106

[22] Filed: Nov. 19, 1990

[51] Int. Cl.[5] ..... C11B 3/10

[52] U.S. Cl. ..... 554/193; 554/191

[58] Field of Search ..... 260/428.5

[56] References Cited

U.S. PATENT DOCUMENTS

| | | | |
|---|---|---|---|
| 2,639,289 | 5/1953 | Vogel | 260/428 |
| 2,985,589 | 5/1961 | Broughton et al. | 210/34 |
| 3,040,777 | 6/1962 | Carson et al. | 137/525.15 |
| 3,422,848 | 1/1969 | Liebman et al. | 137/525.15 |
| 3,706,812 | 12/1972 | De Rosset et al. | 260/674 SA |
| 4,048,205 | 9/1977 | Neuzil et al. | 260/428 |
| 4,056,468 | 11/1977 | Breiter et al. | 210/31 R |
| 4,277,412 | 7/1981 | Logan | 260/428.5 |
| 4,284,580 | 8/1981 | Logan et al. | 260/428.5 |
| 4,310,440 | 1/1982 | Wilson et al. | 252/435 |
| 4,353,838 | 10/1982 | Cleary et al. | 260/419 |
| 4,642,397 | 2/1987 | Zinnen et al. | 568/934 |
| 4,770,819 | 9/1988 | Zinnen | 260/428.5 |
| 4,797,233 | 1/1989 | Zinnen | 260/428.5 |
| 4,877,765 | 10/1989 | Pryor et al. | 502/408 |

OTHER PUBLICATIONS

Duthic et al., J. Chromatog., 51(2) (1970) pp. 319–321.

Wessels, *Pure and Applied Chemistry,* 55(8) (1983) pp. 1381–1385.

Tanak et al., *Lipids,* 15(10) (1980) pp. 872–875.

*Primary Examiner*—José G. Dees

*Assistant Examiner*—Deborah D. Carr

*Attorney, Agent, or Firm*—Thomas K. McBride; John F. Spears, Jr.; Jack H. Hall

[57] ABSTRACT

The separation of free fatty acids from triglycerides is performed by an adsorptive chromatographic process in liquid phase with silica gel as the adsorbent. A ketone, having from 3 to 8 carbon atoms, such as 2-heptanone, an ester or an ether can be selected as the desorbent.

14 Claims, 2 Drawing Sheets

PROCESS FOR SEPARATING FATTY ACIDS AND TRIGLYCERIDES

FIELD OF THE INVENTION

The field of art to which this invention belongs is the solid bed adsorptive separation of glycerides. More specifically, the invention relates to a process for separating free fatty acids from triglycerides by a process which employs a silica gel adsorbent.

BACKGROUND OF THE INVENTION

The separation of many classes of compounds by selective adsorption on molecular sieves or zeolites as well as other adsorbents is well known. Also, various separations based on the degree of unsaturation are known, e.g., esters of saturated fatty acids from unsaturated fatty acids with X or Y zeolites exchanged with a selected cation from U.S. Pat. No. 4,048,205, monoethanoid fatty acids from diethanoid fatty acids with cross-linked polystyrenes, e.g., "Amberlite" from U.S. Pat. No. 4,353,838. A process for separating a mixture of triglycerides, based on the iodine values, is shown in U.S. Pat. Nos. 4,277,412 and 4,284,580 in which permutite and aluminated silica gel adsorbents, respectively, can be used. Similarly, diglycerides have been separated from triglycerides with omega zeolites or silica as the adsorbents, as disclosed in Zinnen U.S. Pat. No. 4,770,819. The refining of oils by admixing them with magnesium silicate to adsorb coloring matter and free fatty acids from glyceride oils is disclosed in U.S. Pat. No. 2,639,289.

U.S. Pat. No. 4,056,468 discloses a combination process of adsorption of aqueous solutions on a silica gel concentration agent and subsequent liquid-liquid extraction of lipophilic-soluble components of the adsorbed species with a lipophilic solvent. Triglycerides and fatty acids are among the lipophilic-soluble materials disclosed that can be isolated from aqueous solutions; however, it is not apparent from the disclosure that fatty acids can be separated from triglycerides by the process. Furthermore, the disclosure relates to analytical separations not suited for continuous bulk separations.

In U.S. Pat. No. 4,877,765, acid-treated amorphous silica was used to remove phospholipids and chlorophyll from glyceride oils as a method of purifying glycerides. There is no teaching of the separation of fatty acids from triglycerides with silica gel.

The use of silica gel in analytical chromatographic separations with various solvent systems is known. Particle sizes of silica gels used in analytical separations ranges from 5 to 50 microns. Also, the removal of various impurities from mixtures including triglycerides is known. However, the usefulness of silica gel as an adsorbent for a bulk separation of fatty acids from triglycerides has not been disclosed or demonstrated.

Illustrative of the analytical separations is Duthic et al, J. Chromatog., 51(2) (1970) pages 319–21 in which fatty acids are isolated from triglycerides with a solvent system of hexane/ethyl acetate/formic acid on plates of silica gel G and developed with sulfuric acid followed by charring in an oven at 120° C. Also, silica gel was utilized in separating polar compounds from non-polar compounds to analyze frying fats according to a report by Wessels, *Pure and Applied Chemistry,* 55(8) (1983), pages 1381–85. See also Tanaka et al, *Lipids* 15(10) (1980) pages 872–875.

The invention herein can be practiced in fixed or moving adsorbent bed systems, but the preferred system for this separation is a countercurrent simulated moving bed system, such as described in Broughton U.S. Patent 2,985,589, incorporated herein by reference. Cyclic advancement of the input and output streams can be accomplished by a manifolding system, which are also known, e.g., by rotary disc valves shown in U.S. Pat. Nos. 3,040,777 and 3,422,848. Equipment utilizing these principles are familiar, in sizes ranging from pilot plant scale (deRosset U.S. Pat. No. 3,706,812) to commercial scale in flow rates from a few cc per hour to many thousands of gallons per hour.

The functions and properties of adsorbents and desorbents in the chromatographic separation of liquid components are well known, but for reference thereto, Zinnen et al U.S. Pat. No. 4,642,397 is incorporated herein.

I have found an adsorbent, which, in combination with certain desorbent liquids, will selectively adsorb all the fatty acids, mono- and diglycerides and impurities contained in various triglyceride feed material; the triglycerides are relatively non-adsorbed and elute as a class near the void. Thus, the largest component of the feed, the triglycerides are eluted as raffinate and the minor components are adsorbed and eluted as extract by desorption with the desorbent. This so-called rejective separation of the major component is desirable since utilities are lower and adsorbent capacity for the adsorbed components, is lower per unit of output product.

I have discovered a method for separating fatty acids, including mixtures of unsaturated and saturated fatty acids, as a class, from triglycerides. The triglycerides also may be a mixture of triglycerides, including saturated, monounsaturated and polyunsaturated.

SUMMARY OF THE INVENTION

The present invention is a process for separating free fatty acids from a feed mixture comprising free fatty acids and at least one triglyceride. The process comprises contacting the mixture at adsorption conditions with an adsorbent comprising an amorphous silica gel. The fatty acids are selectively adsorbed to the substantial exclusion of the triglycerides. Next, the fatty acids are desorbed by a liquid ketone, an ester or an ether or a mixture thereof. Triglycerides are removed before the fatty acids and, together with desorbent, constitute the raffinate. The desorbent may be selected from the ketones having up to 8 carbons, e.g., acetone, the butanones, pentanones, hexanones, heptanones and octanones. Specific examples of ketones useful in the process are acetone, methylethyl ketone, diethyl ketone, methylpropyl ketone, 2-hexanone, 2-heptanone, 3-heptanone, 2-octanone, etc., and mixtures thereof. Other desorbent materials which may be used in the process for the separation of free fatty acids and triglycerides are esters, e.g., methyl butyrate and ethyl butyrate, and ethers, such as glyme, diglyme, ethyl ether, methyl-t-butyl ether (MtBE), and phenyl ether.

In another aspect of the invention, diglycerides contained in certain feeds may be separated from both the triglycerides and the free fatty acids by virtue of the fact that the diglycerides are less strongly adsorbed by the silica gel, but also may be directed to the raffinate product stream and recovered with the triglycerides and to the extract product stream in proportionate amounts as desired, thus providing a large degree of flexibility in formulating the products of the process.

Other embodiments of my invention encompass details about feed mixtures, adsorbents, desorbent materials and operating conditions all of which are hereinafter disclosed in the following discussion of each of the facets of the present invention.

DETAILED DESCRIPTION OF THE INVENTION

Figure 1:
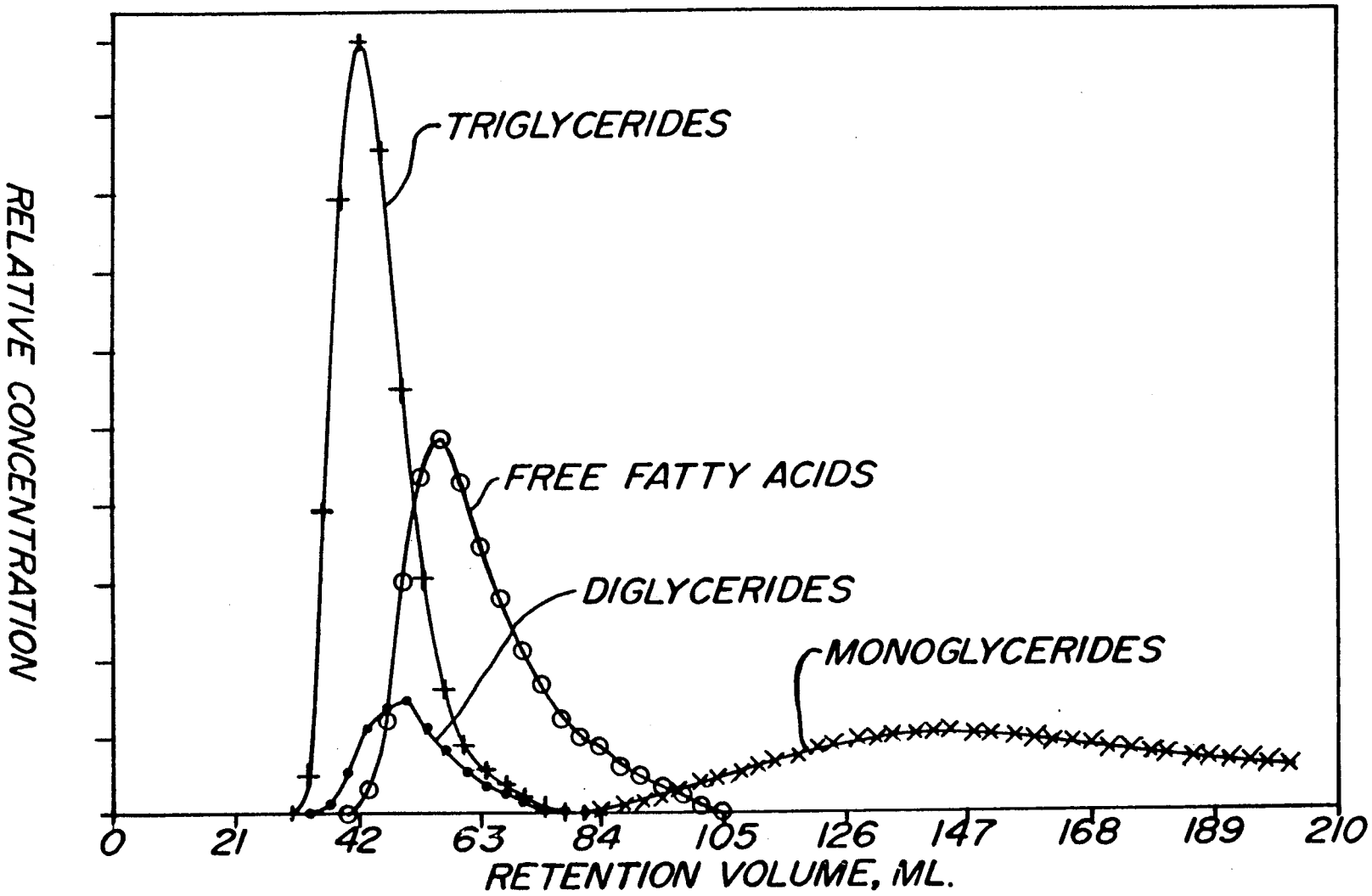
FIG. 1 comprises the chromatographic traces of the pulse tests of Example I showing the separation of free fatty acids, monoglycerides, diglycerides and triglycerides with a silica gel adsorbent and 2-heptanone as desorbent.

Highly unsaturated triglycerides are desirable oils for use in certain foods such a mayonnaise, salad dressings, etc. Such triglycerides can be produced in several ways, but an important route is via an interesterification process wherein triglyceride oils with a low degree of unsaturation can be upgraded by reaction with unsaturated fatty acids. The process may be catalyzed enzymically by a positionally selective lipase catalyst, e.g., *Candida cylindracal, Aspergillis niger, Geotrichum candidum* or various species of Rhizopus. or chemically with an alkali metal or alkaline earth metal catalyst. Such processes are disclosed, for example, in U.S. Pat. No. 4,275,081 (Unilever). The triglyceride fats or oils which may be fed to the interesterification reaction include linseed oil, soybean oil, cotton seed oil, corn oil, peanut oil, palm oil, sunflower oil, safflower oil, canola oil, tallow, lard, olive oil or other naturally occurring fats or oils.

Naturally occurring fats and oils containing substantial quantities of free fatty acids as well as triglycerides may be fed directly to the separation process of the invention, e.g., palm oil, rice bran oil, etc. Partially refined oils or fats such as hydrolyzed canola oil, soybean, cotton seed or corn oil may also be used herein as the feedstock.

The adsorbent used in the invention is silica gel, an amorphous silica having pore diameters greater than about 7 Angstroms (Å) and preferably in the range of 22 to 150 Å, a surface area (BET) ranging from 200 to 700 $m^2/g$, preferably 300–500 $m^2/g$, particle sizes from 20 to 100 mesh (U.S.), pore volume of 0.5 to 1.2 cc/g. The water content of the adsorbent, based on loss on ignition (LOI), is from 0 to 10% (wt.), preferably 0 to 2% (wt.). Silica gels illustrative of the range of values set forth above include: Davisil 646 silica gel, Davisil 636 silica gel and Bead Gel, all available from Davison Division of W. R. Grace & Co and Merck 10181 silica gel. The values are set forth in the following table. Particle size of all the listed materials is in the range of 35–60 Mesh (U.S.).

TABLE 1

| Silica Gel | Pore Size (Å) | Surface Area Pore Vol. cc/g | (BET) $m^2/g$ |
|---|---|---|---|
| Davisil 646 | 150 | 1.15 | 300 |
| Davisil 636 | 60 | 0.75 | 480 |
| Merck 10181 | 40 | 0.68 | 675 |
| Bead Gel | 22 | 0.45 | 800 |

Davisil 636 is preferred in the separation because of its greater capacity. The adsorbents used in the invention are inert and have no exchangeable ions. The pore sizes are also large enough to enable passage by diglycerides in order to eliminate some or all of the diglycerides from the non-adsorbed triglyceride raffinate product; in this regard, pore diameters of zeolites are too small to be useful.

The water content of the adsorbent affects the separation capacity and exchange rates and may also affects its stability. Acceptable levels of water in the adsorbent in terms of LOI are from 0 to 10% (wt.), preferably from 0–2% (wt.) To reduce water content to the desired level, the adsorbent may be dried, e.g., at 80° C. in vacuum or 175° C. in nitrogen gas or at atmospheric conditions.

Other sources of adsorbent deactivation may be the monoglycerides present in the feed or impurity amounts of glycerol, but these may be removed by washing the adsorbent with 2-heptanone.

The general scheme for the rejective adsorption separation such as practiced here is known. Briefly, the less adsorbed feed component(s) is eluted from the non-selective void volume and weakly adsorbing volume before the more strongly adsorbed component(s). The relatively unadsorbed component(s) is thereby recovered in the raffinate. A particular advantage of such a system lies where the unadsorbed fraction or component is large in relation to the other fraction or components, since substantially less adsorbent and smaller sized equipment are required for a given feed throughput than if the large fraction is selectively adsorbed on the adsorbent.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor phase operation. Adsorption conditions include a temperature range of from about 25° C. to about 200° C. with about 50° C. to about 100° C. being preferred and a pressure sufficient to maintain liquid-phase, ranging from about atmospheric to about 400 psig, with from about atmospheric to about 200 psig usually being adequate. Desorption conditions include the same range of temperatures and pressures as used for adsorption conditions.

At least a portion of the raffinate stream, which contains the concentrated mixed triglycerides product, and preferably at least a portion of the extract stream, from the separation process are passed to separation means, typically fractionators or evaporators, where at least a portion of desorbent material is separated to produce a raffinate product and an extract product, respectively.

The desorbent material for the preferred isothermal, isobaric, liquid-phase operation of the process of my invention comprises a low molecular weight ketone having from 3–8 carbon atoms, an ether or an ester. The ketones include acetone, methyl ethyl ketone, diethyl ketone, methylbutyl ketone, 2-heptanone, 3-heptanone, dipropyl ketone, 2-octanone, 3-octanone, etc. The most preferred desorbent materials are the ketones which are listed as acceptable for food use, e.g., 2-heptanone, 3-heptanone and acetone. The esters include methyl butyrate, ethyl butyrate, methyl amylate, ethyl amylate, etc. The ethers include ethyl ether, methyl-t-butyl ether, phenyl ether, 3-methoxyhexane, anisole, glyme, diglyme, etc. The esters and ethers may have up to about 8 carbon atoms, due to boiling point restrictions.

A dynamic testing apparatus is employed to test various adsorbents with a particular feed mixture and desorbent material to measure the adsorption characteristics of retention, capacity and exchange rate. The standard apparatus consists of a helical adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect qualitatively, or determine quantitatively, one or more components in the effluent stream leaving the adsorbent chamber. A pulse test, performed using this apparatus and the following general procedure, is used to determine data, e.g., selectivity, for various adsorbent systems. The adsorbent is placed in a chamber and filled to equilibrium with a particular desorbent material by passing the desorbent material through the adsorbent chamber. At a convenient time, a pulse of feed containing known concentrations of a tracer and of a particular extract component or of a raffinate component or both, all diluted in desorbent material is injected for a duration of several minutes. Desorbent material flow is resumed, and the tracer and the extract component or the raffinate component (or both) are eluted as in a liquid-solid chromatographic operation. The effluent can be analyzed on-stream, or, alternatively, effluent samples can be collected periodically and later analyzed separately by analytical equipment and traces of the envelopes or corresponding component peaks developed.

From information derived from the test, adsorbent performance can be rated in terms of void volume, retention volume for an extract or a raffinate component, the rate of desorption of an extract component from the adsorbent and selectivity. The retention volume of an extract or a raffinate component may be characterized by the distance between the center of the peak envelope of the extract or raffinate component and the center of the peak envelope of the tracer component (void volume) or some other known reference point. It is expressed in terms of the volume in cubic centimeters of desorbent material pumped during this time interval represented by the distance between the peak envelopes. The rate of exchange or desorption rate of an extract component with the desorbent material can generally be characterized by the width of the peak envelopes at half intensity. The narrower the peak width, the faster the desorption rate. Selectivity, $\beta$, is determined by the ratio of the net retention volumes of the more strongly adsorbed component to each of the other components.

The examples shown below are intended to further illustrate the process of this invention without unduly limiting the scope and spirit of said process.

EXAMPLE I

A pulse test as described above was performed to evaluate the process of the present invention for separating free fatty acids, monoglycerides, diglycerides and triglycerides, except that in this test a 35 cc column was used to reduce the volume throughput of desorbent. The column was filled with 35 cc of silica gel (Davisil 636 from W. R. Grace & Co.) and maintained at a temperature of 37° C. and a pressure sufficient to provide liquid-phase operations. Flow volumes reported below were doubled to be comparable to the standard 70 cc column.

Separate pulses of a mixture of the desorbent and the individual components making up a simulated or typical interesterification reaction product were fed to the pulse test apparatus, in sequence. The simulated interesterification reaction product components were safflower oil (mainly triglycerides), distearin, monostearin and hydrolyzed canola oil (free fatty acids). Each pulse consisted of 2 cc of a 2% (vol.) concentration of the component in the desorbent. The hydrolyzed canola oil is a mixture of free fatty acids having the composition in Table 2.

TABLE 2

| Hydrolyzed Canola Oil | |
|---|---|
| Fatty Acid Component | % |
| C:14:0 | 0.1 |
| C14:1 | Trace |
| C16:0 (palmitic acid) | 3.6 |
| C16:1 | 0.2 |
| C18:0 (stearic acid) | 2 |
| C18:1 | 57.1 |
| C18:1 trans | 2.9 |
| C18:2 (linoleic acid) | 19.8 |
| C18:2 | 0.2 |
| C18:3 | 1.2 |
| C18:3 | 6.7 |
| C18:3 | 1.2 |
| C20:0 | 0.5 |
| C20:1 | 1.5 |
| C22:0 | 0.2 |
| C22:1 | 0.4 |
| UNKNOWNS | 2.4 |
| TOTAL | 100 |

The safflower oil was a commerically-available edible oil containing triglycerides, diglycerides and monoglycerides which had been refined, bleached and deodorized. Commerically available samples of distearin and monostearin were used as the diglyceride and monoglyceride, respectively. The desorbent was 2-heptanone. The desorbent material was run continuously at a nominal liquid hourly space velocity (LHSV) of 1 (about 1.1–1.5 ml per minute flow rate). At convenient time intervals, the desorbent was stopped and the feed component-desorbent mixtures were each run for a 1.3–1.8 minute interval at a rate of 1.3–1.5 ml/min. The desorbent stream was resumed at I LHSV after each pulse and continued to pass into the adsorbent column until each of the feed components had been eluted from the column as determined by observing the chromatograph generated by the effluent stream leaving the adsorbent column. The individual chromatographic tracings obtained were overlaid and are shown in FIG. 1. The triglyceride product eluted substantially at the void volume (as determined by n-hexane). The results are also set forth in the following Table 3 of gross retention volumes (GRV), net retention volumes (NRV) and selectivities ($\beta$) based on a 70 cc column, extrapolated from the data obtained from the 35 cc column.

TABLE 3

| Component | GRV | NRV | Selectivity ($\beta$) |
|---|---|---|---|
| Triglycerides | 44.5 | 0.0 | $\infty$ |
| Diglycerides | 49.8 | 5.3 | 2.8 |
| Free Fatty Acids | 59.2 | 14.7 | 1.00 (Ref.) |

TABLE 3-continued

| Component | GRV | NRV | Selectivity (β) |
|---|---|---|---|
| Monoglycerides | 155.1 | 110.6 | 0.13 |

EXAMPLE II

Another pulse test was run on the same column, using only the triglyceride and free fatty acid components of the feed, the same desorbent and under the same conditions as Example I, except that the silica gel was Merck 10181. Merck silica gel 10181 has a surface area of 675 $m^2/g$, a pore volume of 0.68 $cm^3/g$. and pore diameter of 40 Å. The results of the test are as follows:

TABLE 4

| Component | GRV | NRV | Selectivity (β) |
|---|---|---|---|
| Triglycerides | 34.7 | 0 | ∞ |
| Free Fatty Acids | 44.7 | 10.0 | 1.00 (Ref.) |

EXAMPLE III

Additional pulse tests were run in the same manner as Example I in the same column using the adsorbent of Example I with a series of different desorbents, namely, acetone, 2-butanone (methyl ethyl ketone,) 3-pentanone (diethylketone) and ethyl butyrate. The feed components were canola oil (free fatty acids) and safflower oil (triglycerides). The results were all satisfactory and are tabulated (extrapolated to a 70 cc column) in the following Table 5.

TABLE 5

| Desorbent | Acetone | | 2-butanone | | 3-pentanone | | Ethyl butyrate | |
|---|---|---|---|---|---|---|---|---|
| Components | GRV | NRV | GRV | NRV | GRV | NRV | GRV | NRV |
| Triglycerides | 40.4 | 0.0 | 41.0 | 0.0 | 41.4 | 0.0 | 41.8 | 0.0 |
| Free Fatty Acids | 55.0 | 14.0 | 52.4 | 11.4 | 58.2 | 16.8 | 64.2 | 22.4 |

EXAMPLE IV

Another series of pulse tests was run in the same manner as Example I with other desorbents falling within the scope of the invention, namely, acetone, 2-butanone (methyl ethyl ketone) (MEK), methyl-tert-butyl ether (MtBE) and diglyme. The feed components, separately tested, were the same as in Example I, except that each pulse consisted of a 1% (vol.) concentration of the component in the desorbent. The results, again extrapolated to a 70 cc column, are tabulated in Table 6. All were satisfactory, but the use of acetone is especially advantageous in that all monoglycerides are strongly adsorbed and desorbed at the same time as the free fatty acids in the extract.

TABLE 6

| Desorbent | Acetone | | MEK | | MtBE | | Diglyme | |
|---|---|---|---|---|---|---|---|---|
| Components | GRV | NRV | GRV | NRV | GRV | NRV | GRV | NRV |
| Triglycerides | 40.4 | 0.0 | 40.4 | 0.0 | 40.2 | 0.2 | 38.4 | 0.0 |
| Free Fatty Acids | 54.0 | 13.6 | 56.2 | 15.8 | 55.0 | 14.8 | 45.4 | 7.0 |
| Distearin | 41.6 | 1.2 | 43.6 | 3.2 | 46.4 | 6.2 | 41.0 | 2.6 |
| Monostearin | 53.8 | 13.4 | 73.8 | 33.4 | 128.2 | 88.0 | 49.6 | 11.2 |

EXAMPLE V

This example illustrates my process, when operated in a preferred embodiment, utilizing a continuous simulated moving bed countercurrent type of operation comprising a pilot plant scale testing apparatus similar to the manifold arrangement of FIG. 7 described in detail in deRosset et al. U.S. Pat. No. 3,706,812, incorporated herein by reference. Briefly, the apparatus consists essentially of 24 serially connected adsorbent chambers having about 50 cc volume each. Total chamber volume of the apparatus is approximately 1200 cc. The individual adsorbent chambers are serially connected to each other with relatively small diameter connecting piping and to a rotary type valve supplying each of the inlet and outlet streams. By manipulating the rotary valves and maintaining given pressure differentials and flow rates through the various lines passing into and out of the series of chambers, a simulated countercurrent flow is produced. The adsorbent, silica gel (Davisil 636), remains stationary while fluid flows throughout the serially connected chambers in a manner which when viewed from any position within the adsorbent chambers is steady countercurrent flow. The rotary valves are controlled to effect a periodic shifting to allow a new operation to take place in the adsorbent beds located between the active inlet and outlet ports of the rotary valves. Each of the rotary valves is attached to one of the input lines or output lines and directs the respective fluids to and from the individual chambers in sequence. A feed input line contains one rotary valve through which the feed mixture passes, whereby feed can be directed to each of the chambers in a predetermined sequence. A second valve is contained in an extract stream outlet line, through which passes the desorbent material in admixture with free fatty acids, most of the monoglycerides and diglycerides from each of the chambers in sequence. A third and fourth rotary valves are contained, respectively, in a desorbent material inlet line through which passes desorbent materials to individual chambers and a raffinate stream outlet line through which passes triglycerides and some of the diglycerides in admixture with desorbent material from individual chambers.

The feed mixture to the apparatus was a mixture of monoglycerides, diglycerides, triglycerides and free fatty acids resulting from a lipase catalyzed interesterification reaction, having the composition given in Table 7. The desorbent was 2-heptanone.

TABLE 7

| Component | Weight Percent |
|---|---|
| Triglycerides | 37.4 |
| Free Fatty Acids (FFA's) | 57.0 |
| Diglycerides | 5.4 |
| Monoglycerides | 0.2 |

The operating parameters of the carousel unit during two periods of the run were as follows:

1. A/F=3.2 and 3.4, where A is the selective pore volume of the adsorbent in ml/hr and F is the feed rate to the separation stage in ml/hr. The selective pore volume is that volume of the adsorbent which has the ability to selectively adsorb one component of a mixture over another.
2. Process temperature=50° C.
3. Valve cycle time=90 min.

Conditions, however, can vary in practice and to achieve certain performance results. For example, at the process temperature and valve cycle time listed above, zone rates were varied to achieve a range of purity and recovery results.

A number of experiments, each of 6 hours duration, were conducted on the carousel unit. In these experiments, it was observed that the free fatty acids were adsorbed along with the monoglycerides and some of the diglycerides and so were separated with the extract, while the triglycerides and some of the diglycerides were relatively unadsorbed and so were separated with the raffinate. However, the conditions can be set in a well-known manner, e.g., by varying the zone rates to desorb more or less diglycerides and, if desired, remove substantially all the diglycerides in the extract or the raffinate. For example, increasing the zone II rate will increase the concentration of diglycerides in the triglyceride product removed as raffinate. Therefore, a predetermined amount of diglycerides can be directed to the raffinate and extract products. Further, an additional outlet stream may be employed (either a second extract or second raffinate stream) to remove the remainder of the diglycerides, or, if desired, up to substantially all of the diglycerides in the feed. In many food applications, a certain amount of diglycerides may be permitted, e.g., up to about 15%, but preferably about 2–4%, and process conditions may be relaxed, making the separation less costly.

The composition of the extract product streams and raffinate streams for the two periods were as follows:

TABLE 8

| Period | A/F | | FFA's | MG's | DG's | TG's |
|---|---|---|---|---|---|---|
| 1 | 3.2 | Raff. | 0.6 | 0.2 | 0.2 | 99.0 |
| | | Extract | 86.5 | 0.7 | 11.3 | 1.5 |
| 2 | 3.4 | Raff. | 1.5 | 0.2 | 2.8 | 95.6 |
| | | Extract | 90.6 | 0.6 | 8.8 | 0 |

Figure 2:
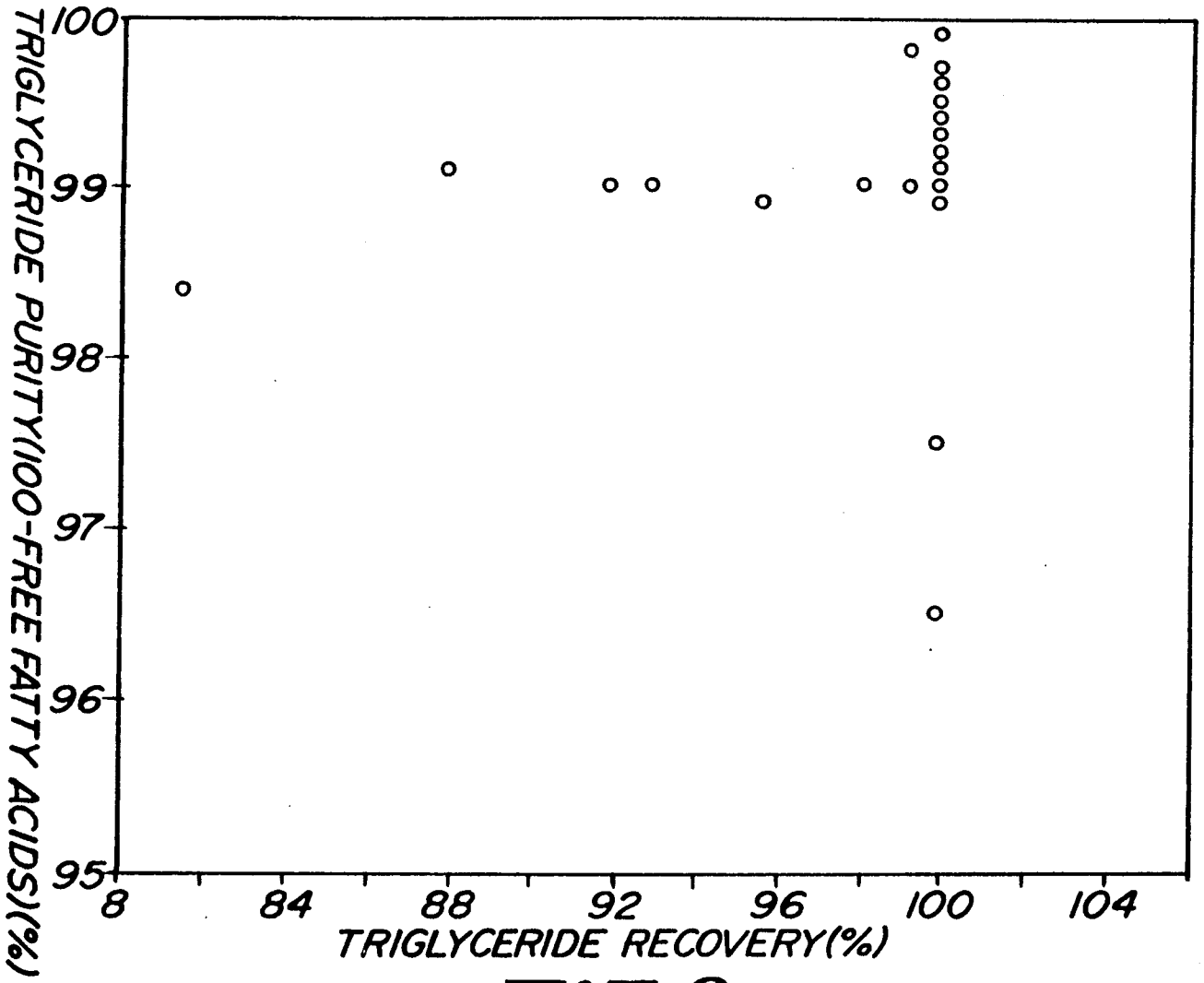
FIG. 2 is a plot of triglyceride purity vs. recovery for the continuous simulated moving bed separation of Example V.

In these experiments the extract and raffinate streams were analyzed for their monoglyceride, fatty acid and di- and triglyceride content. The results of these experiments were plotted and are shown in FIG. 2 as a curve of triglyceride raffinate purity versus triglyceride recovery. The separation performance ranged from triglyceride purity of 96–99% at 99% + recovery. The triglyceride raffinate product can be further freed of fatty acids, where the content is low, e.g., below about 1%, by cooling the raffinate product to 0° C., whereupon the triglycerides are precipitated and can be filtered from the remaining mixture of desorbent and fatty acid.

Thus, it is clear from the above that the use of a silica gel adsorbent enables the separation of triglycerides from a glyceride mixture containing mono-, di- and triglycerides and free fatty acids. Since the effects of different operating conditions on the product purity and yield have not been completely investigated, the results of the above tests are not intended to represent the optimums that might be achieved.

What is claimed is:

1. A continuous, bulk process for separating free fatty acids and triglycerides from a feed mixture comprising free fatty acids and at least one triglyceride, said process comprising contacting said mixture at adsorption conditions with an adsorbent comprising silica gel having particle sizes from 35–60 mesh (U.S.) thereby selectively adsorbing said free fatty acids thereon, removing said triglyceride from contact with said adsorbent and desorbing said free fatty acids at desorption conditions with a desorbent comprising a liquid selected from the group consisting of lower ketones having from 3–8 carbon atoms, esters having up to about 8 carbon atoms and ethers having up to about 8 carbon atoms.

2. The process of claim 1 wherein said adsorption and desorption conditions include a temperature within the range of from about 20° C. to about 20° C. and a pressure sufficient to maintain liquid phase.

3. The process of claim 1 wherein said desorbent is a ketone.

4. The process of claim 3 wherein said ketone is 2-heptanone.

5. The process of claim 3 wherein said ketone is 3-heptanone.

6. The process of claim 3 wherein said ketone is acetone.

7. The process of claim 1 wherein said ester is ethyl butyrate.

8. The process of claim 1 wherein said sesorbent is an ether selected from the group consisting of methyl tert-butyl ether and diglyme.

9. The process of claim 1 wherein said silica gel adsorbent has a water content of from 0–10% (wt).

10. The process of claim 9 wherein said water content is from 0–2%.

11. The process of claim 1 wherein said silica gel is amorphous, and has pore diameters greater than about 7 Å, BET surface area from 200 to 700 $m^2/g$, particle sizes from 35–60 mesh (U.S.) and pore volume of 0.5 to 1.2 cc/g.

12. A continuous, bulk process for separating free fatty acids and triglycerides from a feed mixture comprising free fatty acids, diglycerides and at least one triglyceride, said process comprising contacting said mixture at adsorption conditions with an adsorbent comprising silica gel having particle sizes from 35–60 Mesh (U.S.), thereby selectively adsorbing said free fatty acids thereon, removing said triglyceride and a predetermined amount of said diglycerides from contact with said adsorbent and desorbing said free fatty acids and a second predetermined amount of said diglycerides at desorption conditions with a desorbent comprising a liquid selected from the group consisting of lower ketones having from 3–8 carbon atoms, esters having up to about 8 carbon atoms and ethers having up to about 8 carbon atoms.

13. The process of claim 12 wherein said triglyceride removed from said adsorbent contains up to 15% diglycerides.

14. The process of claim 13 wherein the concentration of diglycerides in said triglycerides removed from said adsorbent is from 2 to about 4%.

* * * * *